US011123770B2

(12) United States Patent
Han

(10) Patent No.: US 11,123,770 B2
(45) Date of Patent: Sep. 21, 2021

(54) SORTING PLATFORM, SYSTEM AND METHOD, AND DATA PROCESSING FOR SORTING SYSTEM

(71) Applicant: BEIJING GEEKPLUS TECHNOLOGY CO., LTD., Beijing (CN)

(72) Inventor: Hao Han, Beijing (CN)

(73) Assignee: BEIJING GEEKPLUS TECHNOLOGY CO., Beijing (CN)

( * ) Notice: Subject to any disclaimer, the term of this patent is extended or adjusted under 35 U.S.C. 154(b) by 15 days.

(21) Appl. No.: 16/616,072

(22) PCT Filed: Dec. 12, 2017

(86) PCT No.: PCT/CN2017/115752
§ 371 (c)(1),
(2) Date: Nov. 22, 2019

(87) PCT Pub. No.: WO2019/061846
PCT Pub. Date: Apr. 4, 2019

(65) Prior Publication Data

US 2020/0086349 A1 Mar. 19, 2020

(30) Foreign Application Priority Data

Sep. 30, 2017 (CN) ..... 201710919999.3
Sep. 30, 2017 (CN) ..... 201710927640.0

(51) Int. Cl.
*B07C 3/00* (2006.01)

(52) U.S. Cl.
CPC ..... *B07C 3/008* (2013.01); *B07C 3/006* (2013.01)

(58) Field of Classification Search
CPC ..... B07C 3/008; B25J 9/1679; B25J 9/163; Y10S 901/46; Y10S 901/02; Y02P 90/02
See application file for complete search history.

(56) References Cited

U.S. PATENT DOCUMENTS

| | | | | |
|---|---|---|---|---|
| 9,962,743 | B2 * | 5/2018 | Bombaugh | B65G 47/38 |
| 10,077,155 | B1 | 9/2018 | Mountz et al. | |
| 2017/0080566 | A1 * | 3/2017 | Stubbs | B25J 9/163 |
| 2017/0157649 | A1 * | 6/2017 | Wagner | B07C 5/36 |
| 2017/0174432 | A1 * | 6/2017 | Zhu | B07C 3/008 |

(Continued)

FOREIGN PATENT DOCUMENTS

| | | |
|---|---|---|
| CN | 103567152 A | 2/2014 |
| CN | 105722770 A | 6/2016 |

(Continued)

OTHER PUBLICATIONS

International Search Report for PCT/CN2017/115752 dated Jun. 28, 2018, with English Translation.

*Primary Examiner* — Patrick H Mackey
(74) *Attorney, Agent, or Firm* — Arent Fox LLP

(57) ABSTRACT

Provided is a sorting platform. The sorting platform includes a body having a first main surface and a second main surface backing onto the first main surface; a supply region disposed in a middle of the first main surface; and a delivery region disposed along an edge of the body. A conveying device receives goods in the supply region and moves along the first main surface of the body to the delivery region so that the conveying device delivers a parcel in the delivery region.

10 Claims, 9 Drawing Sheets

(56) References Cited

U.S. PATENT DOCUMENTS

| | | | | |
|---|---|---|---|---|
| 2018/0282065 | A1* | 10/2018 | Wagner | G06Q 10/087 |
| 2019/0389672 | A1* | 12/2019 | Zhang | B07C 3/00 |
| 2020/0147653 | A1* | 5/2020 | Han | B07C 3/02 |
| 2020/0233421 | A1* | 7/2020 | Han | G05D 1/0214 |
| 2020/0320465 | A1* | 10/2020 | Yang | G06Q 10/0833 |

FOREIGN PATENT DOCUMENTS

| | | | | |
|---|---|---|---|---|
| CN | 105929740 | A | | 9/2016 |
| CN | 205837747 | U | * | 12/2016 |
| CN | 205837747 | U | | 12/2016 |
| CN | 107089464 | A | | 8/2017 |
| CN | 107096721 | A | | 8/2017 |
| CN | 207401774 | U | | 5/2018 |
| JP | 5377961 | B2 | | 12/2013 |
| JP | 2016113291 | A | | 6/2016 |
| JP | 2016159250 | A | | 9/2016 |
| JP | 2016533999 | A | | 11/2016 |
| JP | 2018052671 | A | | 4/2018 |
| WO | 2007011814 | A2 | | 1/2007 |

* cited by examiner

SORTING PLATFORM, SYSTEM AND METHOD, AND DATA PROCESSING FOR SORTING SYSTEM

CROSS-REFERENCES TO RELATED APPLICATIONS

This application is United States National Stage Application of co-pending International Patent Application Number PCT/CN2017/115752, filed on Dec. 12, 2017, which claims priority to a Chinese patent application No. 201710919999.3, filed on Sep. 30, 2017 and a Chinese patent application No. 201710927640.0, filed on Sep. 30, 2017, the contents of which are incorporated herein by reference in their entireties.

TECHNICAL FIELD

The present application relates to the field of parcel sorting techniques and, in particular, to a parcel sorting platform, system and method, and data processing for an item sorting system.

BACKGROUND

The parcel sorting robot system is a logistics sorting system created according to national conditions and geographical factors of our country and in overall consideration of a balance between labor costs in labor-intensive industries and costs of precise and complex automation equipment in our country. With the instant response feature of robots and the flexibility of the distributed system, the parcel sorting robot system can significantly reduce the overall costs of parcel sorting.

SUMMARY

In view of this, a parcel sorting platform, system and method are provided in embodiments of the present application to improve the sorting efficiency and reduce the sorting costs by changing the structure of the sorting platform.

In a first aspect of the present application, a parcel sorting platform is provided. The sorting platform includes a body having a first main surface and a second main surface backing onto the first main surface; a cargo-stacking region disposed in a middle of the first main surface; and a delivery region disposed along an edge of the body. A conveying device receives cargo in the cargo-stacking region and moves along the first main surface of the body to the delivery region so that the conveying device delivers a parcel in the delivery region.

In one embodiment, the delivery region includes an opening penetrating the first main surface and the second main surface so that the conveying device delivers the parcel through the opening to a container disposed on the second main surface of the sorting platform.

In one embodiment, the edge of the body includes a first portion. The first portion includes a structure recessed towards a middle of the body.

In one embodiment, the edge of the body has serrated structures recessed towards the middle of the body.

In one embodiment, the parcel sorting platform further includes a plurality of slideways disposed along the edge of the body and sloping from the second main surface of the body towards a direction away from the first main surface.

In one embodiment, the edge of the body has serrated structures recessed towards the middle of the body.

In a second aspect of the present application, a sorting system is provided. The sorting system includes a sorting platform; a supply device disposed in a middle of the sorting platform; and a conveying device for conveying and delivering a parcel. The sorting platform includes a delivery region located at an edge of the sorting platform. The conveying device receives the parcel from the supply device, moves along a surface of the sorting platform to the delivery region, and delivers the parcel in the delivery region.

In one embodiment, the delivery region includes a plurality of openings penetrating the sorting platform, and the sorting system further includes a plurality of sorting containers disposed in one-to-one correspondence with the plurality of openings so that the conveying device delivers parcels through the plurality of openings to the plurality of sorting containers.

In one embodiment, the edge of the sorting platform has serrated structures recessed towards the middle of the sorting platform.

In one embodiment, the sorting system further includes a plurality of slideways disposed along the edge of the sorting platform.

In one embodiment, the edge of the sorting platform has serrated structures recessed towards the middle of the sorting platform.

In one embodiment, the sorting system further includes a plurality of sorting containers disposed along the edge of the sorting platform and on a side of the sorting platform facing away from the supply device.

In one embodiment, the edge of the sorting platform has serrated structures recessed towards a middle of a body.

In a third aspect of the present application, a parcel sorting method is provided. The parcel sorting method includes operating a parcel to enter a supply device disposed in a middle of a sorting platform; receiving, by a conveying device, the parcel from the supply device and moving along the sorting platform to a delivery region located at an edge of the sorting platform; and delivering, by the conveying device, the parcel to a sorting container in the delivery region.

In one embodiment, the delivery region includes a plurality of openings penetrating two sides of the sorting platform, and delivering, by the conveying device, the parcel to the sorting container in the delivery region includes delivering, by the conveying device, parcels through the plurality of openings to corresponding sorting containers.

In one embodiment, a plurality of slideways are disposed along the edge of the sorting platform, the plurality of slideways are disposed on a side of the sorting platform facing away from the supply device and extend obliquely away from the sorting platform, and delivering, by the conveying device, the parcel to the sorting container in the delivery region includes delivering, by the conveying device, parcels to the plurality of slideways so that the parcels are delivered along the plurality of slideways to corresponding sorting containers.

In the preceding embodiments, the edge of the sorting platform has serrated structures recessed towards the middle of the sorting platform.

The parcel sorting platform, system and method provided in embodiments of the present application improve the sorting efficiency and reduce the sorting costs by changing the parcel delivery position.

In a fourth aspect, a data processing method for an item sorting system is provided in an embodiment of the present application. The method includes acquiring a quantity and route data of to-be-sorted items at a supply end disposed in a middle of the item sorting system within a preset period of time; selecting temporary item storage containers matching the quantity of the to-be-sorted items; and dividing, according to the route data of the to-be-sorted items, the temporary item storage containers into a first temporary item storage container region having a first route and a second temporary item storage container region having a second route.

According to an implementation mode of this embodiment of the present application, the first temporary item storage container region and the second temporary item storage container region form a ring-shaped region, and the ring-shaped region is located outside the item sorting system.

According to an implementation mode of this embodiment of the present application, the method further includes dividing, according to the route data of the to-be-sorted items, the temporary item storage containers into a third temporary item storage container region having a third route.

According to an implementation mode of this embodiment of the present application, the method further includes acquiring other route data excluding the first route and the second route; and creating, among the temporary item storage containers, a first reuse region corresponding to the other route data.

According to an implementation mode of this embodiment of the present application, the method further includes acquiring other route data excluding the first route, the second route and the third route; and creating, among the temporary item storage containers, a second reuse region corresponding to the other route data.

According to an implementation mode of this embodiment of the present application, the method further includes acquiring other route data excluding the first route and the second route; determining whether a route of the other route data exceeds a preset threshold; and if yes, configuring the first temporary item storage container region and the second temporary item storage container region to be in a folded shape.

According to an implementation mode of this embodiment of the present application, the folded shape is any one of a serrated shape, a triangular shape or a wave shape.

In a fifth aspect, a data processing method for an item sorting system is provided in an embodiment of the present application. The method includes acquiring a quantity and route data of to-be-sorted items at a supply end disposed in a middle of the item sorting system within a preset period of time; selecting temporary item storage containers matching the quantity of the to-be-sorted items; calculating a round-trip conveying distance of each of the to-be-sorted items and a delivery selection probability of any route; and setting routes of the temporary item storage containers according to the round-trip conveying distance and the delivery selection probability.

According to an implementation mode of this embodiment of the present application, calculating the round-trip conveying distance of the each of the to-be-sorted items and the delivery selection probability of any route includes for N routes and M temporary item storage containers, calculating one round-trip delivery route distance $S_i$ corresponding to an ith temporary parcel storage container and a probability $P_j$ that an jth route is selected in each delivery.

Setting routes of the temporary item storage containers according to the round-trip conveying distance and the delivery selection probability includes: in a mapping f:i→j between the jth route and the ith temporary item storage container, solving the mapping according to the following optimization:

$$f_{opt}:\ i \rightarrow j = \underset{f:i\rightarrow j}{\operatorname{argmin}} \sum_{i=1}^{N} E(S_i P_i)$$

so that an optimal mapping between the routes and temporary item storage containers satisfies that an expected sum of delivery probabilities of all routes multiplied by delivery route losses of corresponding temporary item storage containers is the minimum.

In a sixth aspect, a data processing apparatus for an item sorting system is provided in an embodiment of the present application. The apparatus includes a first acquisition module, a first selection module and a first division module.

The first acquisition module is configured to acquire a quantity and route data of to-be-sorted items at a supply end disposed in a middle of the item sorting system within a preset period of time.

The first selection module is configured to select temporary item storage containers matching the quantity of the to-be-sorted items.

The first division module is configured to divide, according to the route data of the to-be-sorted items, the temporary item storage containers into a first temporary item storage container region having a first route and a second temporary item storage container region having a second route.

According to an implementation mode of this embodiment of the present application, the first temporary item storage container region and the second temporary item storage container region form a ring-shaped region, and the ring-shaped region is located outside the item sorting system.

According to an implementation mode of this embodiment of the present application, the apparatus further includes a second division module for dividing.

The second division module is configured to divide, according to the route data of the to-be-sorted items, the temporary item storage containers into a third temporary item storage container region having a third route.

According to an implementation mode of this embodiment of the present application, the apparatus further includes a second acquisition module and a first creation module.

The second acquisition module is configured to acquire other route data excluding the first route and the second route.

The first creation module is configured to create, among the temporary item storage containers, a first reuse region corresponding to the other route data.

According to an implementation mode of this embodiment of the present application, the apparatus further includes a third acquisition module and a second creation module.

The third acquisition module is configured to acquire other route data excluding the first route, the second route and the third route.

The second creation module is configured to create, among the temporary item storage containers, a second reuse region corresponding to the other route data.

According to an implementation mode of this embodiment of the present application, the apparatus further includes a fourth acquisition module, a determination module and a configuration module.

The fourth acquisition module is configured to acquire other route data excluding the first route and the second route.

The determination module is configured to determine whether a route of the other route data exceeds a preset threshold.

The configuration module is configured to configure the first temporary item storage container region and the second temporary item storage container region to be in a folded shape when the route of the other route data exceeds the preset threshold.

According to an implementation mode of this embodiment of the present application, the folded shape is any one of a serrated shape, a triangular shape or a wave shape.

In a seventh aspect, a data processing apparatus for an item sorting system is provided in an embodiment of the present application. The apparatus includes a fifth acquisition module, a second selection module, a calculation module and an execution module.

The fifth acquisition module is configured to acquire a quantity and route data of to-be-sorted items at a supply end disposed in a middle of the item sorting system within a preset period of time.

The second selection module is configured to select temporary item storage containers matching the quantity of the to-be-sorted items.

The calculation module is configured to calculate a round-trip conveying distance of each of the to-be-sorted items and a delivery selection probability of any route.

The execution module is configured to set routes of the temporary item storage containers according to the round-trip conveying distance and the delivery selection probability.

According to an implementation mode of this embodiment of the present application, the calculation module is further configured to, for N routes and M temporary item storage containers, calculate one round-trip delivery route distance $S_i$ corresponding to an ith temporary parcel storage container and a probability $P_j$ that an jth route is selected in each delivery.

According to an implementation mode of this embodiment of the present application, the execution module is further configured to, in a mapping f:i→j between the jth route and the ith temporary item storage container, solve the mapping according to the following optimization:

$$f_{opt}: i \rightarrow j = \underset{f:i\rightarrow j}{\operatorname{argmin}} \sum_{i=1}^{N} E(S_i P_i)$$

so that an optimal mapping between the routes and temporary item storage containers satisfies that an expected sum of delivery probabilities of all routes multiplied by delivery route losses of corresponding temporary item storage containers is the minimum.

In an eighth aspect, an electronic device is provided in an embodiment of the present application. The electronic device includes at least one processor and a memory that is communicatively connected to the at least one memory.

The memory stores instructions executable by the at least one processor. The at least one processor executes the instructions to execute the data processing method according to the preceding fourth aspect or any implementation mode of the preceding fourth aspect.

In a ninth aspect, a non-transitory computer-readable storage medium is provided in an embodiment of the present application. The non-transitory computer-readable storage medium is configured to store computer instructions. The computer instructions are configured to operate a computer to execute the data processing method according to the preceding fourth aspect or any implementation mode of the preceding fourth aspect.

In a tenth aspect, an electronic device is provided in an embodiment of the present application. The electronic device includes at least one processor and a memory that is communicatively connected to the at least one memory.

The memory stores instructions executable by the at least one processor. The at least one processor executes the instructions to execute the data processing method according to the preceding fifth aspect or any implementation mode of the preceding fifth aspect.

In a eleventh aspect, a non-transitory computer-readable storage medium is provided in an embodiment of the present application. The non-transitory computer-readable storage medium is configured to store computer instructions. The computer instructions are configured to operate a computer to execute the data processing method according to the preceding fifth aspect or any implementation mode of the preceding fifth aspect.

In a twelfth aspect, a computer program product is provided in an embodiment of the present application. The computer program product includes a computer program stored on a non-transient computer-readable storage medium. The computer program includes program instructions that, when executed by a computer, enable the computer to execute the data processing method according to the preceding fourth aspect or any implementation mode of the preceding fourth aspect.

In a thirteenth aspect, a computer program product is provided in an embodiment of the present application. The computer program product includes a computer program stored on a non-transient computer-readable storage medium. The computer program includes program instructions that, when executed by a computer, enable the computer to execute the data processing method according to the preceding fifth aspect or any implementation mode of the preceding fifth aspect.

A data processing method and apparatus for an item sorting system, and an electronic device provided in embodiments of the present application are used to extract data of the item sorting system and deploy temporary item storage containers in the item sorting system by use of the extracted data so as to make an optimized mapping between routing information and the physical positions of the temporary item storage containers and are used to improve the sorting efficiency through the special arrangement and the optimized mapping.

DETAILED DESCRIPTION

Figure 1:
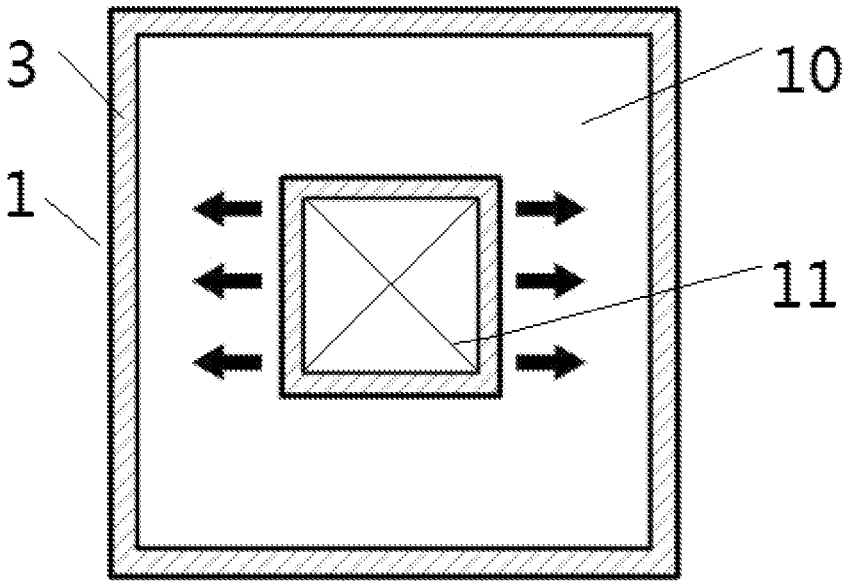
FIG. 1 is a schematic diagram of a sorting platform according to an embodiment of the present application.

Solutions in embodiments of the present application will be described clearly and completely in connection with the drawings in embodiments of the present application. Apparently, the embodiments described below are merely part, not all, of embodiments of the present application. Based on the embodiments described herein, other embodiments obtained by those of ordinary skill in the art on the premise that no creative work is done are within the scope of the present application.

A parcel conveying system based on a steel platform structure is a special form of the parcel conveying system. The parcel conveying system based on a steel platform structure is characterized in that the steel structure platform is disposed in a sorting warehouse, and parcels are conveyed by a conveying line onto the steel platform, manually removed from the conveying line and placed on a conveying device (such as a robot), and finally delivered by the robot to a particular position under the steel platform via a bucket well so that the parcels are sorted.

In a conventional sorting system based on a steel platform structure, bucket wells are evenly distributed in the field and a space is reserved between each two buckets. The reserved space has the following function: On the steel platform, robots can travel in the space between each two buckets. Under the steel platform, a packing table is disposed under each bucket to ensure a large space for the packing table. Otherwise, if the buckets are close to each other, the region of the packing table will be greatly compressed.

However, the buckets disposed in a separated manner are marked as obstacles by a robot in the field. Excessive obstacles affect the route planning of the robot, reduce the use efficiency of part of the field and finally affect the sorting efficiency.

The following describes the reasons why the bucket wells distributed in a separated manner on the steel platform and spaced from each other reduce the sorting efficiency.

(1) While running, the robot system divides the field into, for example, square cells to create a grid coordinate system composed of square cells in the field. After receiving a motion task, a robot learns of the starting point and the ending point and travels in the grid according to the route planned by the system. In general, a route planned by the system may be a route formed by connection of a number of cells. For example, a robot, starting from any cell, can only reach four adjacent cells and cannot directly reach its four diagonal cells.

(2) When a robot is about to travel at a turn of a planned route, the robot needs to decelerate, stop, then rotate in situ, and finally accelerate and leave the turn. In this process, if a second robot is expected to pass this turn after the preceding robot, the second robot has to stop and wait. Thus, as the number of turns planned by the system increases, the average running speed of the robot decreases due to multiple accelerations and decelerations. Furthermore, deceleration of one robot may have a chain effect, which in turn causes chain deceleration of other robots.

(3) When obstacles are present in the field, a route planned for a robot by the system may have more turns such that the robot can reach the destination. Thus, the obstacles reduce the average running speed of all robots and thereby affect the sorting efficiency.

(4) The probability that a robot travels in gradually decreases with the distance in the direction in which cells located at the same longitude or latitude as an obstacle face towards the obstacle compared with the direction in which these cells back onto the obstacle. Thus, the probability that these cells are used is also reduced. Thus, in the map where obstacles exist, each cell has a different probability of being used. The probability of route selection for the robot is reduced, so the sorting efficiency is reduced.

For the preceding reasons, a parcel sorting platform is provided in one aspect of the present application. Referring to FIG. 1, the sorting platform 1 includes a body 10 having a first main surface 21 and a second main surface 22 backing onto the first main surface 21; a supply region 11 disposed in a middle of the first main surface; and a delivery region 3 disposed along an edge of the body 10. A conveying device receives cargo (for example, parcels such as to-be-sorted goods) in the supply region 11 and moves along the first main surface 21 of the body 10 to the delivery region 3 so that the conveying device delivers parcels in the delivery region 3. In the present application, the delivery region is disposed at the edge of the sorting platform so that obstacles on the sorting platform are reduced and the parcel sorting efficiency of the conveying device is improved.

For ease of description, the present application will be described below in conjunction with specific sorting robots in place of conveying devices, but it is to be understood by those skilled in the art that the conveying devices in the present application are not limited to sorting robots and may be other devices that can carry parcels and move.

It is to be noted that the sorting platform 1 may be a conventional steel platform structure or may be a platform made of other materials. The first main surface and the second main surface are the largest two surfaces of the sorting platform 1. A supply region 11 is disposed on one of the main surfaces. For example, a supply device may be disposed in the supply region 11. In this way, after a parcel is conveyed through a conveyor belt to the supply device, the operator can pick up the parcel and put the parcel on a sorting robot so that the robot can carry the parcel to the delivery region 3. In addition, sorting containers may be disposed on the second main surface of the sorting platform so that a sorting robot can deliver parcels to these containers.

In one embodiment, the delivery region 3 includes an opening penetrating the first main surface and the second main surface so that the conveying device delivers a parcel through the opening to a container disposed on the second main surface of the sorting platform. The opening is also commonly referred to as a bucket. The opening has the following function: A sorting robot moves on one surface of the sorting platform, and after the robot moves to the delivery region, the robot can deliver a parcel to the opening so that the parcel can fall through the bucket under the action of gravity to a sorting container disposed under the sorting platform. It is thus known that the size of an opening should allow a parcel to pass through the opening. Preferably, the opening is a circular opening so that the parcel can easily pass through the opening and will not be scratched by the opening. It is to be noted that the sorting platform is generally spaced apart from the surface where sorting containers are placed, and the sorting containers are disposed in one-to-one correspondence with the openings so that a parcel can fall through an opening under the action of gravity to a corresponding sorting container.

Figure 2:
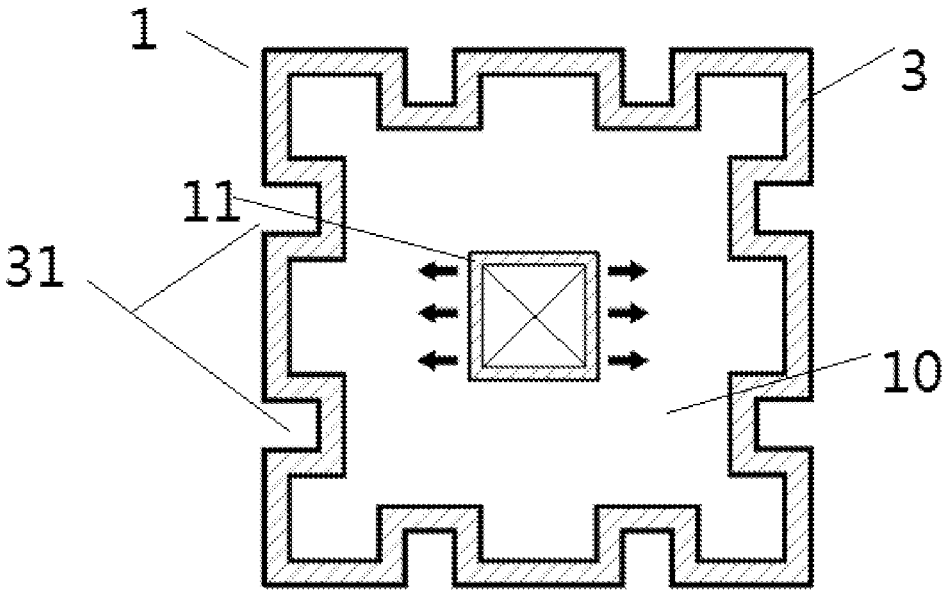
FIG. 2 is a schematic diagram of a sorting platform having serrated structures according to an embodiment of the present application.

Referring to FIG. 2, in one embodiment, the edge of the body 10 includes a first portion, and the first portion includes a structure 31 recessed towards the middle of the body 10. That is, the outer edge of the body 10 is not a uniform structure. The outer edge of the body 10 may include a structure that is recessed towards the middle of the body 10, that is, includes gaps, so that the edge of the body has a larger size. On the one hand, the sorting field where the sorting platform is located may have limitations. For example, the position corresponding to the edge of the sorting platform may not have enough space. On the other hand, when a large number of sorting containers are needed, the length of the edge of the sorting platform may not allow placement of too many sorting containers. In this case, openings through which parcels are configured to pass through are disposed along the edge of the sorting platform. Thus, the length of the edge of the sorting platform is increased to increase the number of openings on the sorting platform and allow placement of more sorting containers.

In this embodiment, continuing referring to FIG. 2, for example, the outer edge of the sorting platform 1 may have serrated structures 31, thereby further increasing the length of the outer edge of the sorting platform 1 and allowing placement of more sorting containers correspondingly under the sorting platform 1. Preferably, the recessed portion of the serrated structure 31 may be an arc-shaped structure (not shown). For example, each side of the sorting platform 1 having a rectangular structure (in a top view) on the whole may be an arc-shaped structure (not shown) recessed towards the middle of the body 10 so that the processing difficulty of the sorting platform is reduced and the mechanical property is improved.

Figure 3A:
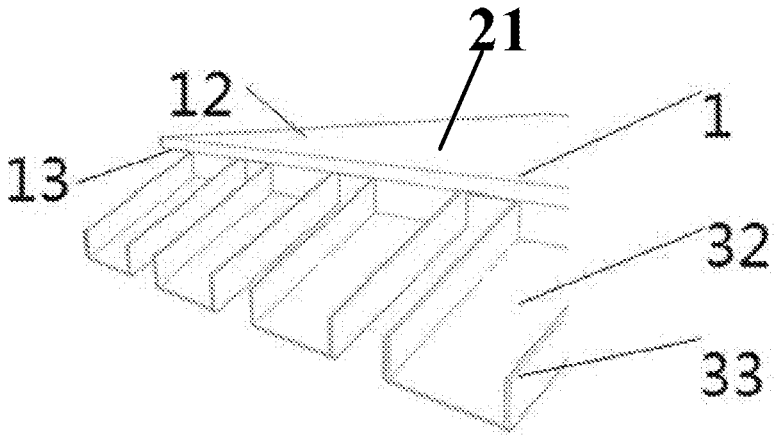
FIGS. 3A and 3B are structure diagrams showing sloping slideways according to an embodiment of the present application.

Referring to FIG. 3A, in one embodiment, the parcel sorting platform 1 further includes a plurality of slideways 32 disposed along the edge of the body 10 and sloping from the second main surface 22 of the body 10 towards a direction away from the first main surface 21. Under the slideways 32, sorting containers, for example, may be disposed in one-to-one correspondence with the slideways 32. That is, a sorting robot delivers, in the delivery region 3, a parcel from above a slideway 32 (near the sorting platform), and the parcel slides along the slideway 32 to a sorting container corresponding to the slideway 32. Preferably, the barrier structure 33 may be provided on both sides of the slider 32 to prevent the parcel from slipping out of the slider. In addition, the inclination angle of a slideway may be, for example, in the range of 38-72 degrees to prevent a parcel from being stuck on the slideway.

Similarly, in this embodiment, the edge of the body 10 has serrated structures 31 that are recessed towards the middle of the body 10. That is, the length of the edge of the body 10 is extended so that more sloping slideways 32 are disposed to improve the parcel sorting ability.

Figure 3B:
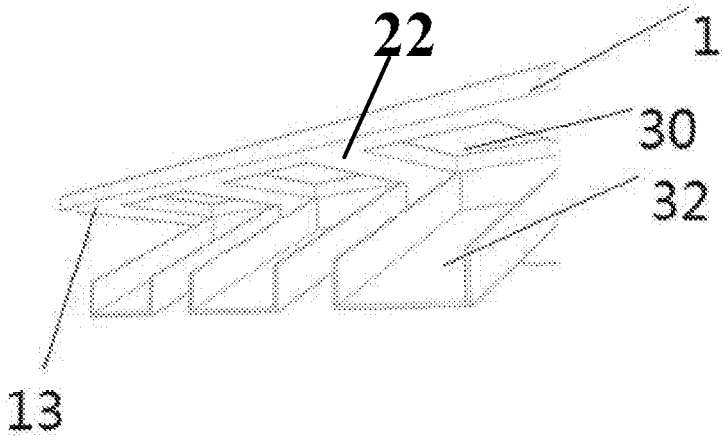

It is to be noted that, in order to prevent parcels from being damaged after the parcels fall under the action of gravity, sloping slideways may be disposed at the openings. Referring to FIG. 3B, that is, each opening 30 may cooperate with a corresponding sloping slideway 32 and each sorting container is disposed under a corresponding sloping slideway 32 so that a parcel can slide into a sorting container slowly. In contrast to the structure in which sloping slideways are disposed at the outer edge of the sorting platform 1, the structure in which openings 30 are disposed within the outermost edge of the sorting platform 1 can prevent a robot from falling off the sorting platform 1 due to a motion error after the robot moves to the edge of the sorting platform 1, that is, can ensure safe and reliable motion of the sorting robot.

Figure 4:
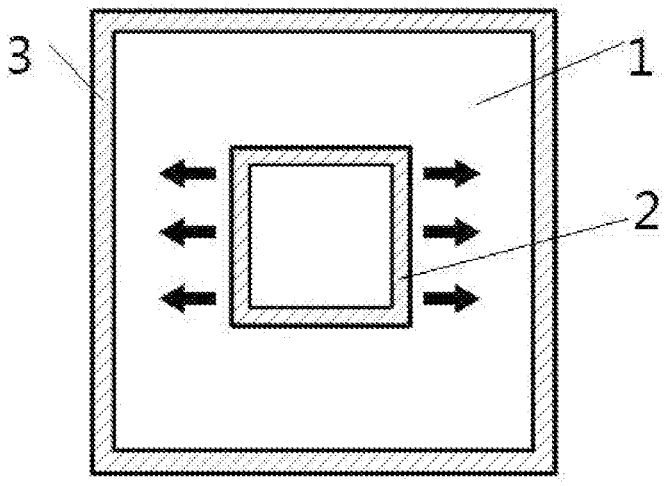
FIG. 4 is a schematic diagram of a sorting system according to an embodiment of the present application.

In another aspect of the present application, a sorting system is provided. Referring to FIG. 4, the sorting system includes a sorting platform 1, a supply device 2 disposed in the middle of the sorting platform 1, and a sorting robot (not shown) for conveying and delivering a parcel. The sorting platform 1 includes a delivery region 3 located at the edge of the sorting platform 1. The sorting robot receives the parcel from the supply device 2, moves along one surface of the sorting platform 1 to the delivery region 3, and delivers the parcel in the delivery region 3. In the sorting system, the delivery region 3 is disposed at the edge of the sorting platform 1 so that roadblocks on the sorting platform 1 are reduced and the motion efficiency of the sorting robot is improved.

It is to be noted that the supply device disposed on the sorting platform 1 is usually connected to a parcel conveyor belt (not shown), and the parcel is conveyed to the supply device 2 via the conveyor belt. Thereafter, the parcel is rotated on the supply device 2. The worker can place the parcel on the sorting robot so that the sorting robot carries the parcel to the delivery region 3. Preferably, the supply device 2 is a ring-shaped rotary belt (as shown in the figure) so that the operator can stand in the middle of the ring-shaped rotary belt to operate the parcel. In this way, the motion region of the sorting robot is separated from the motion region of the operator so that the operator and the robot do not run into each other during motion.

In one embodiment, the delivery region 3 includes a plurality of openings penetrating the sorting platform, and the sorting system further includes a plurality of sorting containers disposed in one-to-one correspondence with the plurality of openings so that the sorting robot delivers parcels through the plurality of openings to the plurality of sorting containers. Since the delivery region 3 is located at the edge of the sorting platform, the plurality of openings are also disposed in the vicinity of the outer edge of the sorting platform 1 so as not to affect the motion of the sorting robot. Likewise, the size of the opening should be such that the parcel can pass through the opening. Preferably, the opening may be a circular opening.

Figure 5:
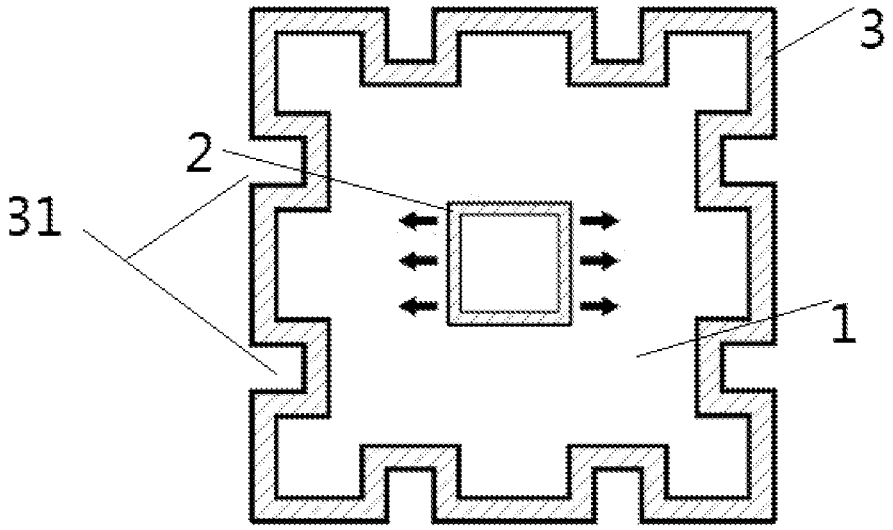
FIG. 5 is a schematic diagram of a sorting system of a sorting platform having a serrated structure according to an embodiment of the present application.

Referring to FIG. 5, in one embodiment, the edge of the sorting platform 1 has structures recessed towards the middle of the sorting platform 1. That is, the outer edge of the sorting platform may be a non-uniform structure. The non-uniform structure may include a structure 31 that is recessed towards the middle of the sorting platform, that is, may include gaps. On the one hand, the sorting field where the sorting platform 1 is located may have limitations. For example, the position corresponding to the edge of the sorting platform 1 may not have enough space. On the other hand, when a large number of sorting containers are needed, the length of the edge of the sorting platform 1 may not allow placement of too many sorting containers. In this case, openings through which parcels are configured to pass through are disposed along the edge of the sorting platform. Thus, the length of the edge of the sorting platform 1 is increased to increase the number of openings on the sorting platform and allow placement of more sorting containers.

In this embodiment, continuing referring to FIG. 5, for example, the outer edge of the sorting platform 1 may have serrated structures 31, thereby further increasing the length of the outer edge of the sorting platform 1 and allowing placement of more sorting containers correspondingly under the sorting platform 1. Preferably, the recessed portion of the serrated structure 31 may be an arc-shaped structure (not shown). For example, each side of the sorting platform 1 having a rectangular structure (in a top view) on the whole may be an arc-shaped structure recessed towards the middle of the body so that the processing difficulty of the sorting platform is reduced and the mechanical property is improved.

Figure 6A:
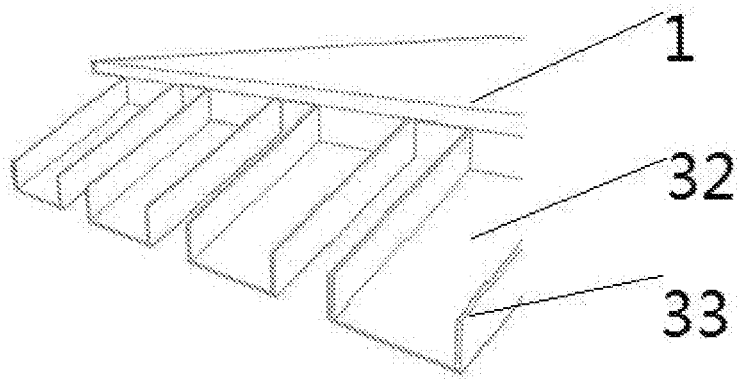
FIGS. 6A and 6B are schematic diagrams of a sorting system having sloping slideways according to an embodiment of the present application.

Referring to FIG. 6A, in one embodiment, the sorting system further includes a plurality of slideways 32 disposed along the edge of the sorting platform 1. Under the slideways 32, sorting containers, for example, may be disposed in one-to-one correspondence with the slideways 32. A sorting robot delivers, in the delivery region, a parcel from above a slideway 32, and the parcel slides along the slideway 32 to a sorting container corresponding to the slideway 32. Preferably, barrier structures 33 may be disposed on both sides of a slideway 32 to prevent a parcel from slipping out of the slideway 32. In addition, the inclination angle of a slideway 32 may be, for example, in the range of 38-72 degrees to prevent a parcel from being stuck on the slideway 32.

Similarly, in this embodiment, the edge of the body has serrated structures 31 that are recessed towards the middle of the body. That is, the length of the edge of the body is extended so that more sloping slideways 32 are disposed to improve the parcel sorting ability.

Figure 6B:
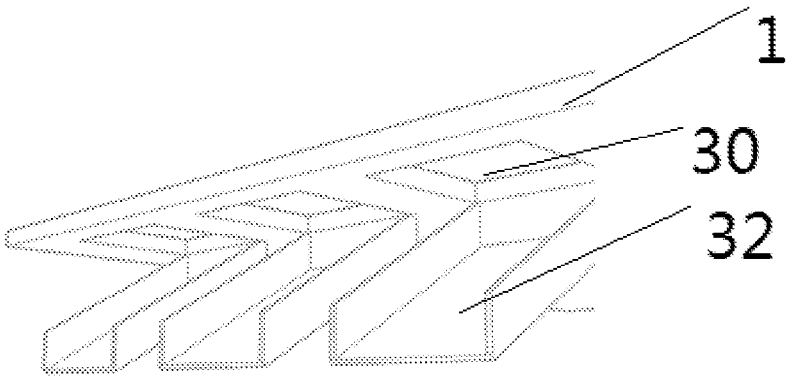

Referring to FIG. 6B, to prevent parcels from being damaged after the parcels fall under the action of gravity, sloping slideways 32 may be disposed at the openings 30. That is, each opening 30 may cooperate with a corresponding sloping slideway 32 and each sorting container is disposed under a corresponding sloping slideway 32 so that a parcel can slide into a sorting container slowly. In this structure, openings 30 are disposed within the outermost edge of the sorting platform, thereby preventing a robot from falling off the sorting platform 1 due to a motion error after the robot moves to the edge of the sorting platform 1, that is, ensuring safe and reliable motion of the sorting robot.

Figure 7:
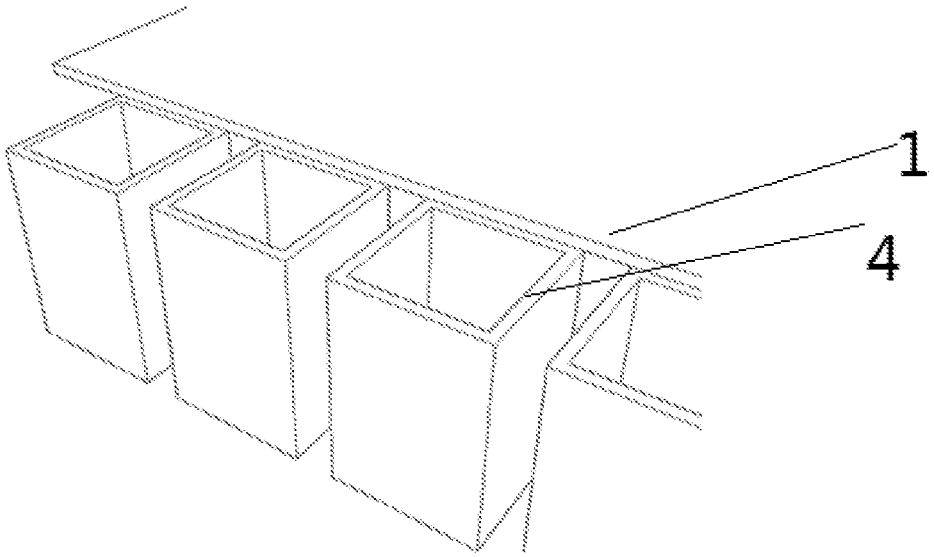
FIG. 7 is a schematic diagram of a sorting system in which sorting containers are disposed at an edge of a sorting platform according to an embodiment of the present application.

Referring to FIG. 7, in one embodiment, the sorting system further includes a plurality of sorting containers 4 disposed along the edge of the sorting platform 1 and facing away from the supply device 2. The openings of these sorting containers 4 include at least portions located outside the sorting platform 1 so that a sorting robot can deliver parcels directly into the sorting container 4 as it moves to the delivery region.

Figure 8:
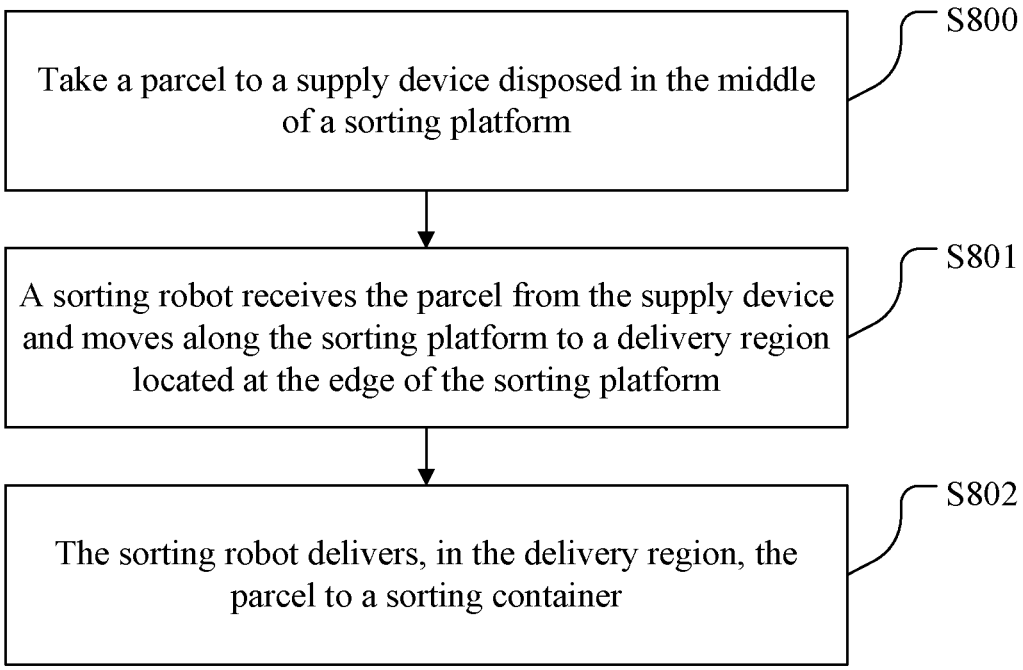
FIG. 8 is a schematic diagram of a parcel sorting method according to an embodiment of the present application.

In another aspect of the present application, a parcel sorting platform is provided. Referring to FIG. 8, the method includes the steps described below.

In S800, a parcel is taken to a supply device disposed in the middle of a sorting platform. For example, the parcel may be conveyed to the supply device via a parcel conveyer belt so that the parcel can rotate with the supply device.

In S801, a sorting robot receives the parcel from the supply device (for example, the operator may pick up the parcel from the supply device and place the parcel on the sorting robot) and moves along the sorting platform to a delivery region located at the edge of the sorting platform.

In S802, the sorting robot delivers, in the delivery region, the parcel to a sorting container.

In the parcel sorting method according to this embodiment of the present application, since obstacles to the motion of the sorting robot are reduced, each position between the delivery region and the rotation region is selected by the sorting robot at the same probability. Thus, the sorting efficiency is increased and the sorting costs are reduced.

As previously described, in one embodiment, the delivery region 3 includes a plurality of openings 30 penetrating both sides of the sorting platform 1, and the sorting robot delivers, in the delivery region, the parcel to the sorting container in the following manner: The sorting robot delivers the parcel to the corresponding sorting container 4 via an opening 30.

In one embodiment, a plurality of slideways 32 are disposed along the edge of the sorting platform 1. The slideways 32 are disposed on the side of the sorting platform 1 away from the supply device 2. The slideways 32 extend obliquely away from the sorting platform 1. (For example, the end of each of the slideways facing away from the sorting platform may extend outward from the sorting platform. That is, when viewed from right above the sorting platform, one end of each of the slideways is outside the sorting platform so that it is convenient for the operator to operate sorting containers under the slideways.) The sorting robot delivers, in the delivery region 3, the parcel to the sorting container 4 in the following manner: The sorting robot delivers the parcel to one of the slideways 32 so that the parcel can slide along the slideway 32 into the corresponding sorting container 4. The slideways disposed along the edge of the sorting platform can prevent parcels from being damaged.

In some embodiments described above, the edge of the sorting platform 1 may be a non-uniform structure. For example, the edge may include a structure 31 that is recessed towards the middle of the sorting platform 1. For example, the structure 31 may be a serrated structure. In this way, more openings or slideways can be disposed at the openings to improve the sorting ability of the sorting system.

The parcel sorting platform, system and method provided in embodiments of the present application improve the sorting efficiency and reduce the sorting costs by changing the parcel delivery position.

Embodiments of the present application will be described below in detail with reference to the accompanying drawings.

Apparently, the described embodiments are merely part, not all, of embodiments of the present application. Based on the embodiments described herein, other embodiments obtained by those of ordinary skill in the art on the premise that no creative work is done are within the scope of the present application.

Figure 9:
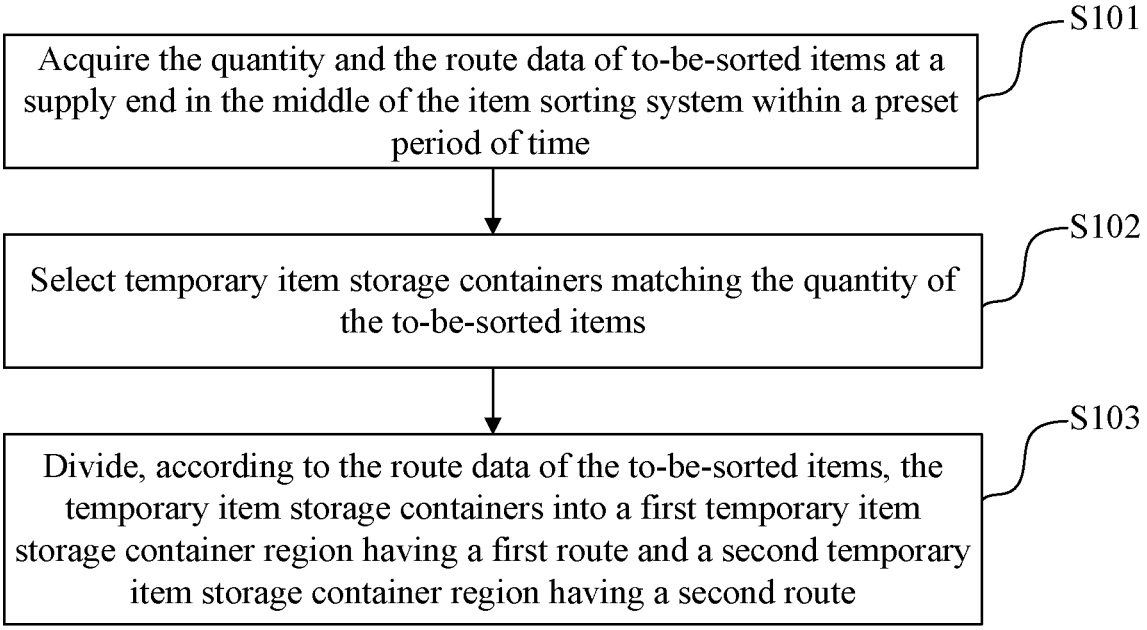
FIG. 9 is a flowchart of data processing method for an item sorting system according to an embodiment of the present application.

Referring to FIG. 9, a data processing method for an item sorting system is provided in an embodiment of the present application. The method includes the steps described below.

In S101, the quantity and the route data of to-be-sorted items at a supply end disposed in the middle of the item sorting system within a preset period of time is acquired.

The item sorting system generally has a control server that can acquire the quantity of to-be-sorted items at the supply end within a period of time. On this basis, the control server can acquire the quantity and the route data of to-be-sorted items at the supply end within a preset period of time.

Figure 13:
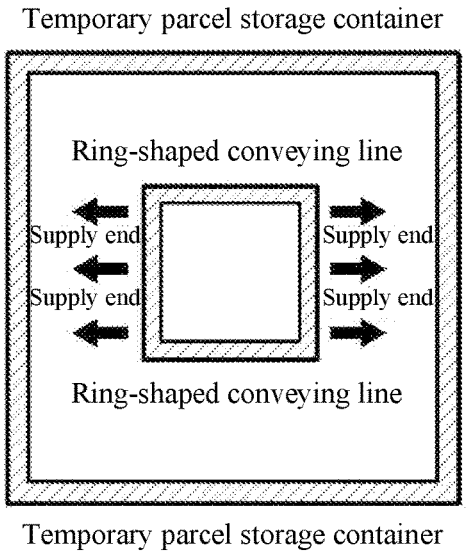
FIG. 13 is a structure diagram of an item sorting system according to an embodiment of the present application.

In addition to the arrangement of the conventional item sorting system, as a specific application scenario, the solution in this embodiment of the present application may be applied to a system in which the supply end is located in the middle of the item sorting system. Referring to FIG. 13, supply ends are located around a ring-shaped conveying line, and have different orientations. The to-be-sorted items provided by the supply end may be conveyed to a specified temporary item storage container via a device like a logistics robot. Temporary item storage containers are located at the periphery of the item sorting system and form one or more continuous patterns (straight line, curve, square, rectangle, circle, ellipse or other shapes).

In S102, temporary item storage containers matching the quantity of the to-be-sorted items are selected.

Temporary item storage containers whose quantity matches the quantity of the to-be-sorted items learnt of at the supply end are selected. For example, if the quantity of to-be-sorted items at the supply end is 500, and the quantity of items that can be accommodated by each temporary item storage container is 10 on average, at least 50 temporary item storage containers are required. As another example, if the conveying destinations of the to-be-sorted items at the supply end are 20 different locations, then at least 20 temporary item storage containers are required to accommodate the to-be-sorted items to be conveyed to different destinations.

In S103, the temporary item storage containers are divided, according to the route data of the to-be-sorted items, into a first temporary item storage container region having a first route and a second temporary item storage container region having a second route.

Using a parcel sorting system as an example, as shown in FIG. 13, the middle of the field is provided with a ring-shaped conveying line, and temporary parcel storage containers are placed around the field. Thus, each supply end has a different distance from each temporary parcel storage container. The route in which a robot moves from a supply end to a temporary parcel storage container is referred to as a "delivery route". The delivery distance is the shortest when a robot receives a parcel at the west side of the map and needs to deliver the parcel to a parcel storage container at the west side of the map. The delivery distance is the longest when a robot receives a parcel at the west side of the map but needs to deliver the parcel to a parcel storage container at the east side of the map and thus has to travel around half of the field before delivering the parcel.

Accordingly, the temporary parcel storage containers are divided, in the field, into multiple logical regions. Each logical region corresponds to a particular supply end. Temporary parcel storage containers in each logical region accept only parcels of specified several supply ends. One supply end may correspond to multiple logical regions. One delivery route is limited within one logical region so that one delivery route does not cross multiple logical regions. FIG. 14B illustrates the arrangement of buckets when the sorting field is divided into two logical regions.

Figure 14A:
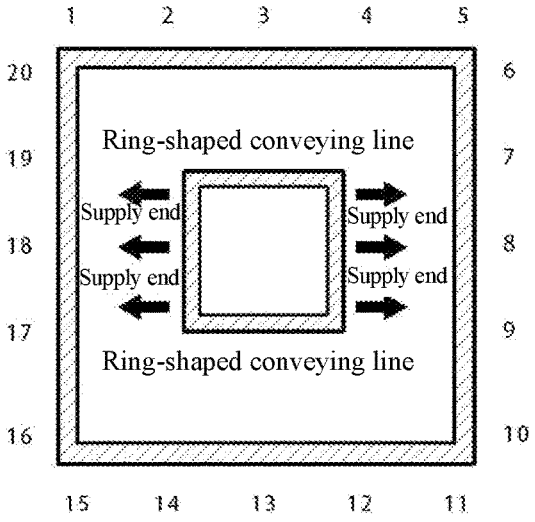
FIGS. 14A to 14B are schematic diagrams of another item sorting system according to an embodiment of the present application.
Figure 14B:
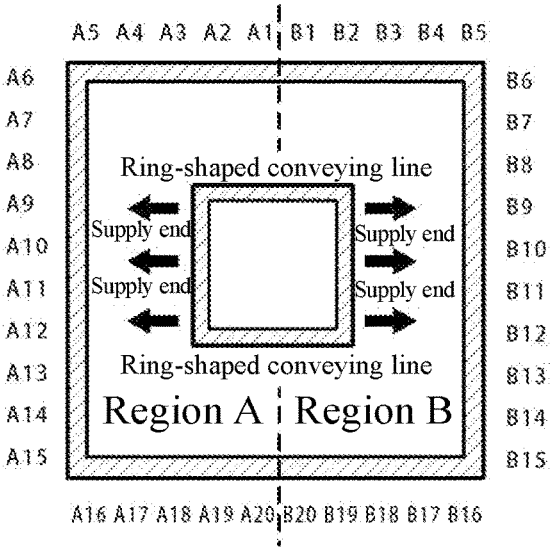

As shown in FIG. 14A, in the basic arrangement, multiple temporary parcel storage containers are arranged along the extension of the field according to serial numbers. As shown in FIG. 14B, after the field is divided into multiple logical regions, each logical region has its own corresponding temporary parcel storage containers. The routes corresponding to the containers are in a mirroring arrangement in the map and reused within multiple logical regions. That is, each logical region covers all the routes. Parcels from the supply ends within one logical region are delivered only to containers within particular logical regions. Delivery to all routes is completed just in the logical regions. FIG. 14B illustrates only a case where the field is divided into two logical regions. In this method, the field may be divided into multiple regions depending on the actual situation. Thus, the desired distance of the delivery route will become shorter.

Figure 10:
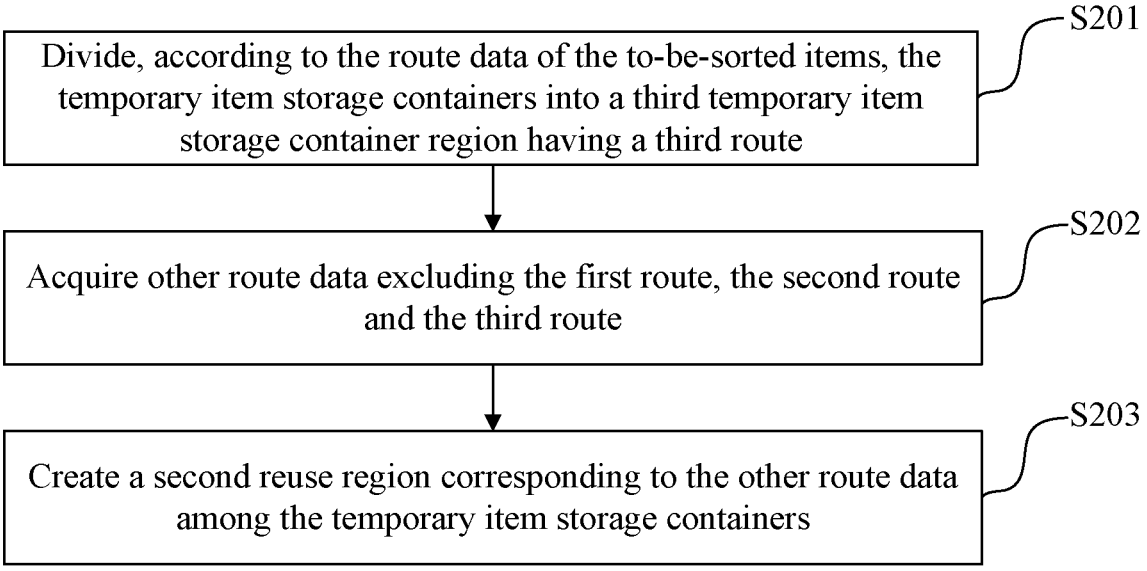
FIG. 10 is a flowchart of creating a second reuse region according to an embodiment of the present application.

Referring to FIG. 10, in addition to steps S101 to S103, the method may further include the steps described below.

In S201, the temporary item storage containers are divided, according to the route data of the to-be-sorted items, into a third temporary item storage container region having a third route.

In S202, other route data excluding the first route, the second route and the third route is acquired.

In S203, a second reuse region corresponding to the other route data is created among the temporary item storage containers.

Figure 15:
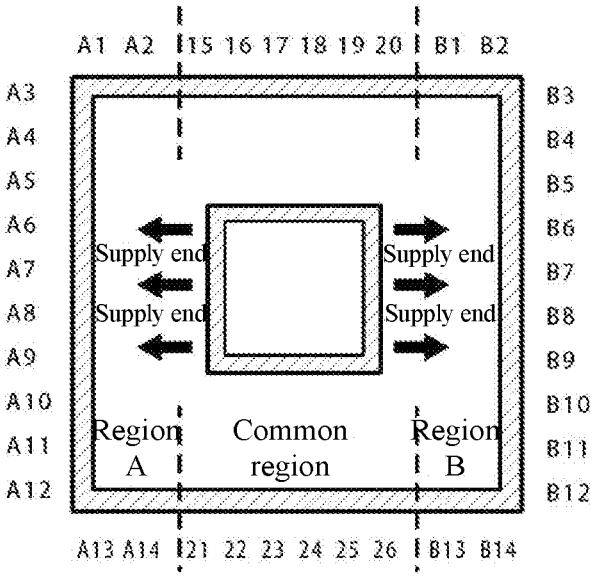
FIG. 15 is a structure diagram of another item sorting system according to an embodiment of the present application.

Still using a parcel sorting system as an example, when routes are reused among logical regions, the quantity of containers to be disposed will be doubled. When the length of the edge of the field is not sufficient to accommodate all reused containers, logical regions may be reduced and do not have to accommodate all routes. Also, routes not included in logical regions are used in mixture outside multiple logical regions, and the region where containers used in mixture are deployed is defined as a common region. As shown in FIG. 15, when excessive routes exist, excessive containers are required due to reuse in logical regions and the space required for deployment of containers is greater than the allowable range at the edge of the field. In this case, a common region as shown in FIG. 15 may be added. Each logical region partially contains the same routes and shares routes in the common region.

Also, the common region should be disposed at a position from which the routes to the supply ends of the logical regions are equal. When the field is divided into two logical regions, the common region is in the middle of the field.

Figure 11:
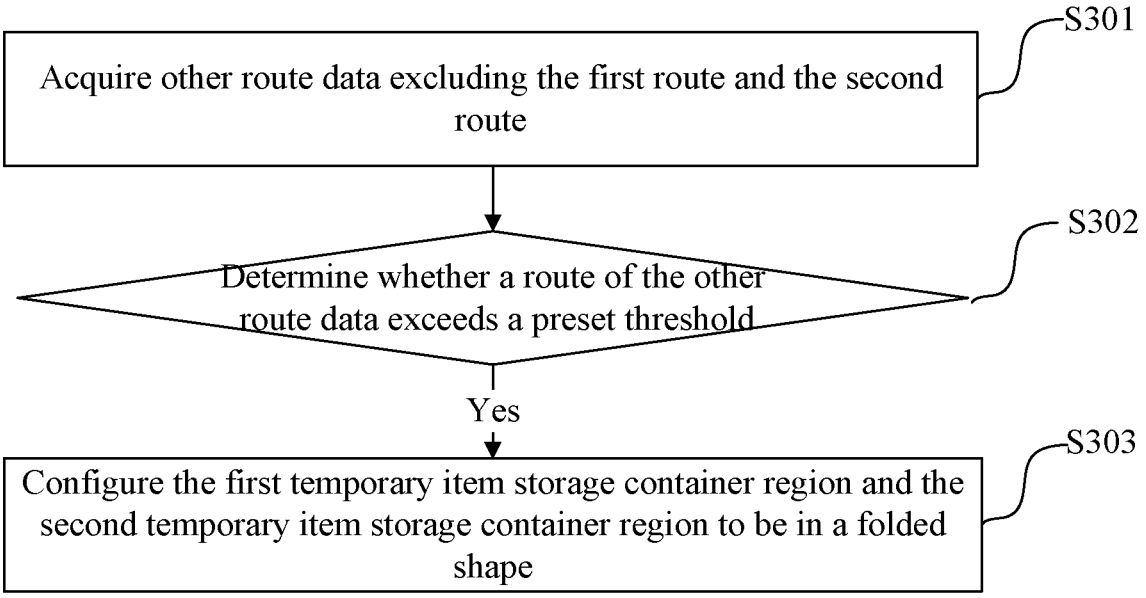
FIG. 11 is a flowchart of configuring temporary item storage container regions to be in a folded shape according to an embodiment of the present application.

Optionally, referring to FIG. 11, the data processing method for an item sorting system may further include the steps described below.

In S301, other route data excluding the first route and the second route is acquired.

In S302, it is determined whether a route of the other route data exceeds a preset threshold.

In S303, if yes, the first temporary item storage container region and the second temporary item storage container region are configured to be in a folded shape.

Figure 16:
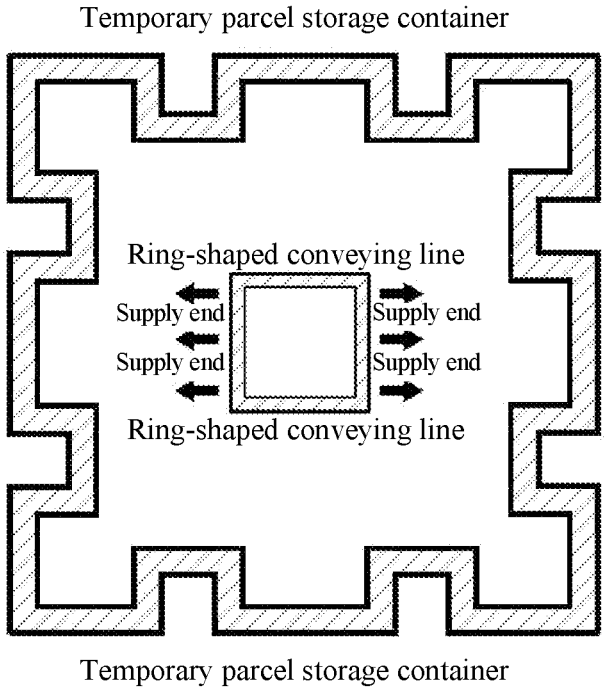
FIG. 16 is a structure diagram of another item sorting system according to an embodiment of the present application.

A serrated shape or, of course, another similar shape may be the specific application of the folded shape. A serrated arrangement may be used to continue increasing the quantity of temporary parcel storage containers that the field can accommodate when the following two cases occur: There are too many routes, and even if there is no reuse in logical regions, there is still not enough space around the field to accommodate all containers; when reuse is performed in logical regions, since there are a large number of routes, the number of routes accommodated by logical regions is far less than the total number of routes, most of the field is a common region, and the meaning of using logical regions to reduce the delivery route distance is gradually lost. The serrated container arrangement as shown in FIG. 16 changes the edge around the field to a serrated shape. Such arrangement extends the perimeter of the field and thus increases the quantity of deployable temporary parcel containers.

Figure 12:
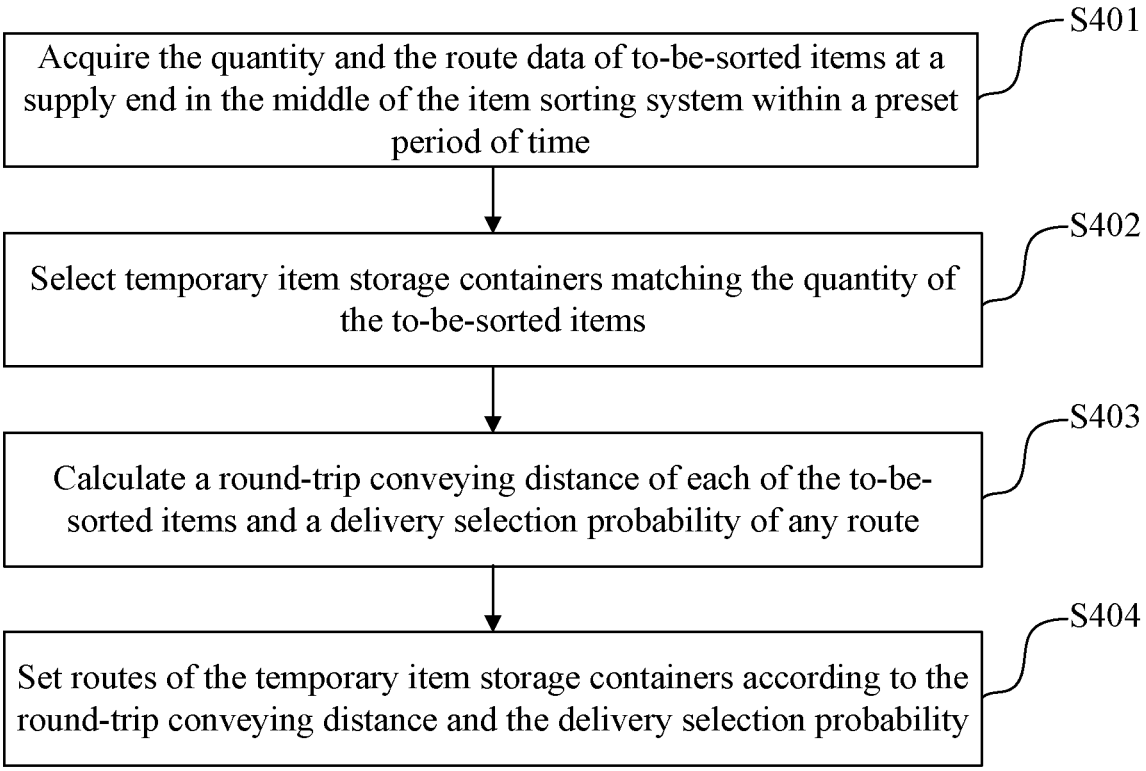
FIG. 12 is a flowchart of another data processing method for an item sorting system according to an embodiment of the present application.

As another implementable method, referring to FIG. 12, another data processing method for an item sorting system is provided in an embodiment of the present application.

In S401, the quantity and the route data of to-be-sorted items at a supply end disposed in the middle of the item sorting system within a preset period of time are acquired.

The item sorting system generally has a control server that can acquire the quantity of to-be-sorted items at the supply end within a period of time. On this basis, the control server can acquire the quantity and the route data of to-be-sorted items at the supply end within a preset period of time.

In addition to the arrangement of the conventional item sorting system, as a specific application scenario, the solution in this embodiment of the present application may be applied to a system in which the supply end is located in the middle of the item sorting system. Referring to FIG. 13, supply ends are located around a ring-shaped conveying line, and have different orientations. The item sorting system may be a parcel sorting system. Temporary item storage containers are distributed around the item sorting system. The temporary item storage containers may be temporary parcel storage containers. The to-be-sorted items provided by the supply end may be conveyed to a specified temporary item storage container via a device like a logistics robot. Temporary item storage containers are located at the periphery of the item sorting system and form one or more continuous patterns (straight line, curve, square, rectangle, circle, ellipse or other shapes).

In S402, temporary item storage containers matching the quantity of the to-be-sorted items are selected.

Temporary item storage containers whose quantity matches the quantity of the to-be-sorted items learnt of at the supply end are selected. For example, if the quantity of to-be-sorted items at the supply end is 500, and the quantity of items that can be accommodated by each temporary item storage container is 10 on average, at least 50 temporary item storage containers are required. As another example, if the conveying destinations of the to-be-sorted items at the supply end are 20 different locations, then at least 20 temporary item storage containers are required to accommodate the to-be-sorted items to be conveyed to different destinations.

In S403, a round-trip conveying distance of each of the to-be-sorted items and a delivery selection probability of any route are calculated.

It is assumed that N routes and M temporary parcel storage containers exist in the field, one round-trip delivery route distance corresponding to the ith temporary parcel storage container is $S_i$, the probability that the jth route is selected in each delivery is $P_j$, and i, $j \in \{1, 2, \ldots, N\}$. Each probability satisfies the following relationship:

$$\sum_{j=1}^{N} P_j = 1$$

In S404, routes of the temporary item storage containers are set according to the round-trip conveying distance and the delivery selection probability.

In a mapping $f: i \rightarrow j$ between the jth route and the ith container, the mapping is solved according to the following optimization:

$$f_{opt}: i \rightarrow j = \underset{f: i \rightarrow j}{\operatorname{argmin}} \sum_{i=1}^{N} E(S_i P_i)$$

That is, the optimal mapping between routes and temporary item storage containers satisfies that the expected sum of delivery probabilities of all routes multiplied by delivery route losses of corresponding containers is the minimum. That is, a container with a smaller delivery route should be mapped to a route with a larger delivery probability. The mapping between containers and routes in this manner can significantly reduce the distance covered by a robot delivering the equivalent number of parcels, thereby improving the sorting efficiency of the system.

Figure 17:
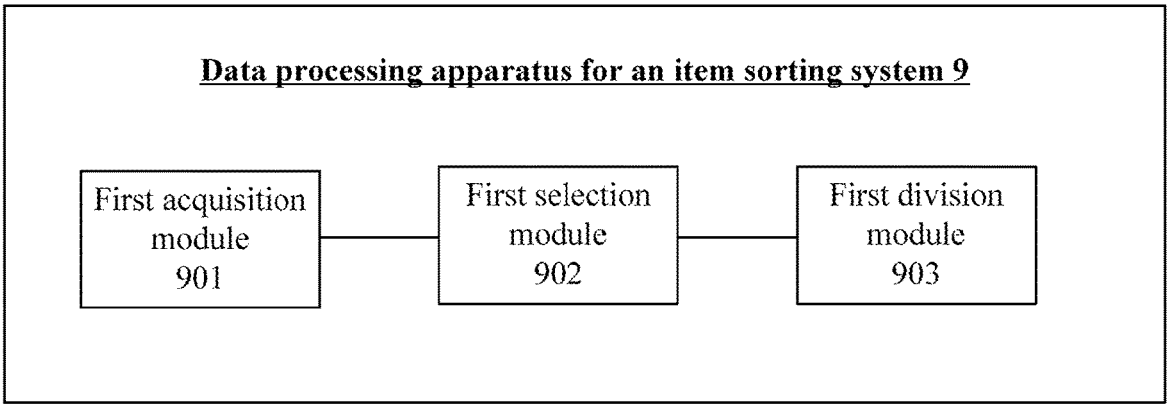
FIG. 17 is a structure diagram of a data processing apparatus for an item sorting system according to an embodiment of the present application.

Corresponding to the method embodiment of FIG. 9, referring to FIG. 17, a data processing apparatus for an item sorting system is provided in an embodiment of the present application. The apparatus includes a first acquisition module 901, a first selection module 902 and a first division module 903.

The first acquisition module 901 is configured to acquire a quantity and route data of to-be-sorted items at a supply end disposed in a middle of the item sorting system within a preset period of time.

The first selection module 902 is configured to select temporary item storage containers matching the quantity of the to-be-sorted items.

The first division module 903 is configured to divide, according to the route data of the to-be-sorted items, the temporary item storage containers into a first temporary item storage container region having a first route and a second temporary item storage container region having a second route.

The functions and content performed by the functional modules in this embodiment are in one-to-one correspondence with those in the corresponding method embodiment. Details are not described here again.

Figure 18:
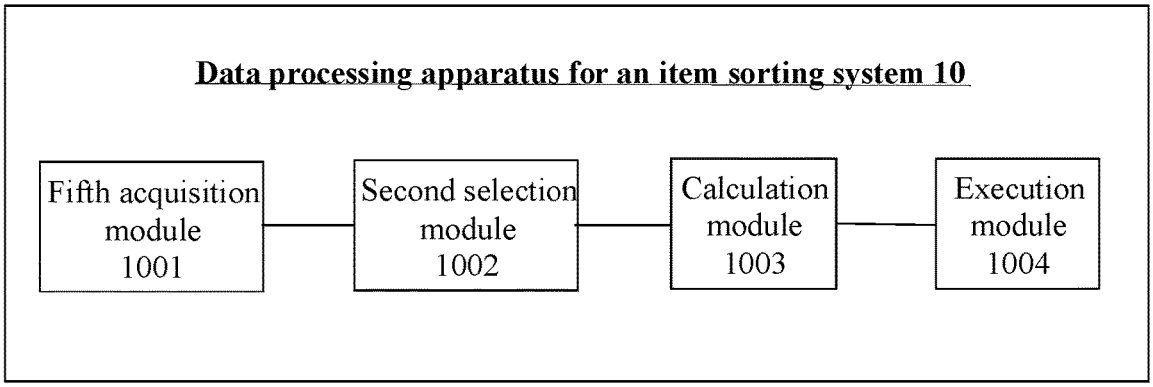
FIG. 18 is a structure diagram of another data processing apparatus for an item sorting system according to an embodiment of the present application.

Corresponding to the method embodiment of FIG. 12, referring to FIG. 18, a data processing apparatus for an item sorting system is provided in an embodiment of the present application. The apparatus includes a fifth acquisition module 1001, a second selection module 1002, a calculation module 1003 and an execution module 1004.

The fifth acquisition module 1001 is configured to acquire a quantity and route data of to-be-sorted items at a supply end disposed in a middle of the item sorting system within a preset period of time.

The second selection module 1002 is configured to select temporary item storage containers matching the quantity of the to-be-sorted items.

The calculation module 1003 is configured to calculate a round-trip conveying distance of each of the to-be-sorted items and a delivery selection probability of any route.

The execution module 1004 is configured to set routes of the temporary item storage containers according to the round-trip conveying distance and the delivery selection probability.

The functions and content performed by the functional modules in this embodiment are in one-to-one correspondence with those in the corresponding method embodiment. Details are not described here again.

Figure 19:
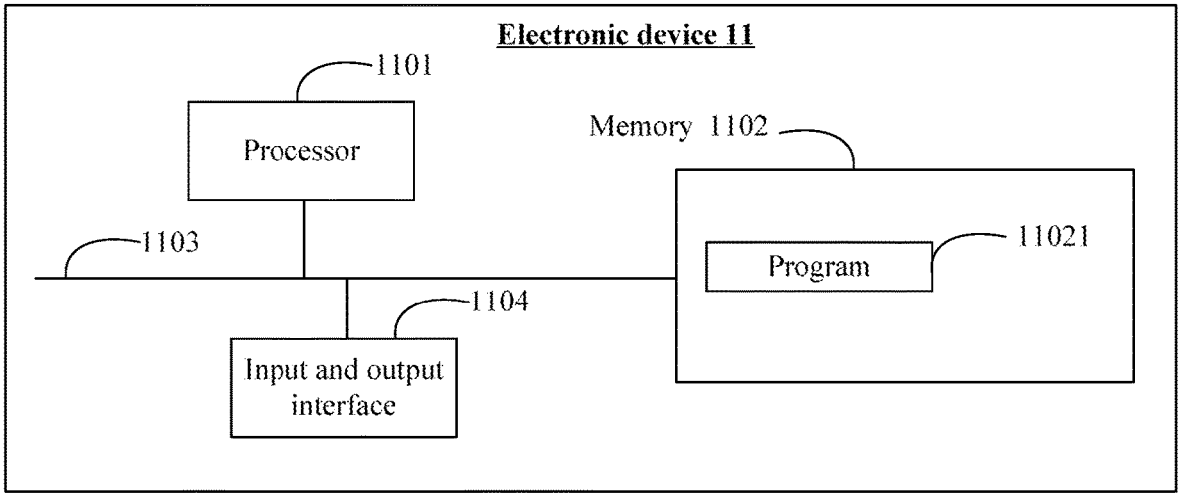
FIG. 19 is a structure diagram of an electronic device according to an embodiment of the present application.

FIG. 19 is a structure diagram of an electronic device 11 according to an embodiment of the present application. The electronic device 11 is configured to perform the steps or content of the method embodiments of the present application. The electronic device 11 includes at least one processor 1101 (for example, a CPU), at least one input/output interface 1104, a memory 1102, and at least one communication bus 1103 for implementing connection and communication between these components. The at least one processor 1101 is configured to execute an executable module, such as a computer program, stored in the memory 1102. The memory 1102 is a non-volatile memory that may include a volatile memory like a random access memory (RAM) or may include a non-volatile memory like at least one disk storage. The at least one input/output interface 1104 (which may be a wired or wireless communication interface) is configured to implement communicative connection to at least one other network element.

In some implementation modes, the memory 1102 stores a program 11021, and the processor 1101 executes the program 11021 to execute any preceding method embodiment.

The electronic device may be in a variety of forms, including but not limited to the forms described below.

(1) A mobile communication device: This type of device is characterized in that this type of device has a mobile communication function and has a main object of providing voice and data communication. This type of terminal includes a smartphone, a multimedia mobile phone, a functional mobile phone and a low-end mobile phone.

(2) A super-mobile personal computer device: This type of device belongs to the category of a personal computer, has computing and processing functions, and generally has a feature of mobile Internet surfing. This type of terminal includes a personal digital assistant (PDA), a mobile internet device (MID), an ultra-mobile personal computer (UMPC) and the like.

(3) A portable entertainment device: This type of device can display and play multimedia content. This type of device includes an audio and video player (for example, a portable media player), a palm game machine, an e-book, a smart toy and a portable on-board navigation device.

(4) A specific server: This type of device is a device for providing a computing service. The server is composed of a processor, a hard disk, a memory, a system bus and the like. The server has an architecture similar to the architecture of a general-purpose computer. However, since a highly reliable service needs to be provided, requirements are high in terms of processing capacity, stability, reliability, security, scalability, manageability and the like.

(5) Other electronic devices having a data interaction function.

It is to be noted that in the present application, relationship terms such as "first" and "second" are used merely to distinguish one entity or operation from another, and do not necessarily require or imply any such actual relationship or sequence between these entities or operations. Furthermore, the term "comprising", "including" or any other variant thereof is intended to encompass a non-exclusive inclusion so that a process, method, item or device that includes a series of elements not only includes the expressly listed elements but may also include other elements that are not expressly listed or are inherent to such process, method, item or device. In the absence of more restrictions, the elements defined by the statement "including a . . . " do not exclude the presence of additional identical elements in the process, method, item or device that includes the elements.

Embodiments in this specification are described in a manner of correlation. The same or similar parts in the embodiments can be referred to by each other. Each embodiment focuses on differences from other embodiments.

In particular, the apparatus embodiments are similar to the method embodiments and thus are described briefly. For related content, see part of the description of the method embodiments.

The logic and/or steps represented in a flowchart or described herein in other manners, for example, may be considered as a sequential list of executable instructions for implementing logical functions, and may be implemented in any computer-readable medium so as to be used by instructions to implement a system, apparatus or device (for example, a computer-based system, a system including a processor, or other systems that can fetch and execute instructions among instructions used to implement the system, apparatus or device) or may be used in conjunction with these instructions to implement the system, apparatus or device. As regards this specification, the "computer-readable medium" may be any apparatus that may include, store, communicate, propagate or transmit programs so as to be used by instructions to implement a system, apparatus or device or may be used in conjunction with these instructions to implement the system, apparatus or device. More specific examples (non-exhaustive list) of the computer-readable medium include an electrical connecting piece (electronic device) having one or more wirings, a portable computer disk box (magnetic device), a random access memory (RAM), a read-only memory (ROM), an erasable editable read-only memory (EPROM) or flash memory, an optical fiber device, and a portable compact disk read-only memory (CDROM). In addition, the computer-readable medium may even be a paper or other suitable media on which the programs can be printed. This is because, for example, it is feasible to optically scan the paper or other suitable media and then to edit, interpret or process, if necessary, in other proper ways so that the programs are obtained electronically and then stored in a computer memory.

It is to be understood that the portions of the present application may be implemented by hardware, software, firmware, or combinations thereof.

In the preceding implementation modes, multiple steps or methods may be implemented by software or firmware stored in a memory and executed by a suitable instruction execution system. For example, if implemented by hardware, as in another implementation mode, the steps or methods may be implemented by any of the following techniques known in the art or combinations thereof: a discrete logic circuit having a logic gate circuit for implementing logic functions for data signals, an application-specific integrated circuit having a suitable combinational logic gate circuit, a programmable gate array (PGA) or a field programmable gate array (FPGA) or the like.

The preceding are only embodiments of the present application and are not intended to limit the present application. It is easy for those skilled in the art to conceive modifications or substitutions within the scope of the present application. These modifications or substitutions are within the scope of the present application. Accordingly, the scope of the present application should be subject to the scope of the claims.

It is to be understood that the term "one" should be construed as "at least one" or "one or more". That is, in one embodiment, the number of elements may be one, and in other embodiments, the number of the elements may be more than one. The term "one" should be construed as limiting the number of certain elements.

Ordinal numbers like "first" and "second" are used to describe various components and not to limit the components. These terms are used merely to distinguish one component from another. For example, the first component may be referred to as the second component and, likewise, the second component may also be referred to as the first component, without departing from the teachings of the inventive concept. The term "and/or" used herein includes any and all combinations of one or more associated listed items.

The terms used herein are intended only to describe various embodiments and not to limit the embodiments. As used herein, a singular form is intended to include a plural form unless otherwise clearly instructed in the context. In addition, it is to be understood that the term "include" and/or "have" used in the specification is intended to specify the presence of the feature, quantity, step, operation, component, element or combinations thereof and not to exclude the presence or addition of one or more other features, quantities, steps, operations, components, elements or combinations thereof.

The terms used herein, including technical and scientific terms, have the same meanings as those commonly understood by those skilled in the art as long as the terms are not defined differently. It is to be understood that terms defined in a commonly used dictionary have meanings consistent with the meanings of the terms in the existing art.

The preceding are only embodiments of the present application and are not intended to limit the present application. It is easy for those skilled in the art to conceive modifications or substitutions within the scope of the present application. These modifications or substitutions are within the scope of the present application. Accordingly, the scope of the present application should be subject to the scope of the claims.

What is claimed is:

1. A sorting platform, comprising:

a body having a first main surface and a second main surface backing onto the first main surface;

a supply region disposed in a middle of the first main surface; and a delivery region disposed along an edge of the body, wherein a conveying device receives goods in the supply region disposed in the middle of the first main surface of the body and moves along the first main surface of the body to the delivery region so that the conveying device delivers the goods in the delivery region;

wherein the delivery region comprises a plurality of openings penetrating the first main surface and the second main surface so that the conveying device delivers the goods through the plurality of openings to a container disposed under the second main surface of the sorting platform and corresponding to a respective one of the plurality of openings.

2. The sorting platform of claim 1, wherein the delivery region comprises a plurality of slideways that slope from the second main surface of the body towards a direction away from the first main surface.

3. The sorting platform of claim 1, wherein an edge of the body has serrated structures recessed towards the middle of the body.

4. The sorting platform of claim 1, further comprising: a plurality of slideways disposed under the plurality of openings and disposed in one-to-one correspondence with the plurality of openings, and wherein plurality of slideways slope from the second main surface of the body towards a direction away from the first main surface.

5. The sorting platform of claim 1, wherein the delivery region comprises a plurality of sorting containers disposed along the edge of the body and on a side of the body facing away from the supply region.

6. A sorting system, comprising: a sorting platform, wherein the sorting platform comprises: a body having a first main surface and a second main surface backing onto the first main surface;

a supply region disposed in a middle of the first main surface; and a delivery region disposed along an edge of the body;

wherein the sorting system further comprises: a supply device disposed in the supply region of the sorting platform;

and a conveying device for conveying and delivering goods; and wherein the conveying device receives the goods from the supply device, moves along the first main surface of the body of the sorting platform to the delivery region, and delivers the goods in the delivery region;

wherein the delivery region comprises a plurality of openings penetrating the first main surface and the second main surface, and the sorting system further comprises a plurality of sorting containers disposed in one-to-one correspondence with the plurality of openings so that the conveying device delivers goods through one of the plurality of openings to a respective one of the plurality of sorting containers.

7. The sorting system of claim 6, further comprising: a plurality of slideways disposed under a plurality of openings penetrating the first main surface and the second main surface and disposed in one-to-one correspondence with the plurality of openings, and wherein the plurality of slideways slope from the second main surface of the body towards a direction away from the first main surface.

8. The sorting system of claim 6, wherein an edge of the sorting platform has serrated structures recessed towards the middle of the sorting platform.

9. The sorting system of claim 6, wherein the plurality of sorting containers are disposed along the edge of the body and on a side of the body facing away from the supply device.

10. The sorting system of claim 6, wherein the delivery region comprises a plurality of slideways that slope from the second main surface of the body towards a direction away from the first main surface.

* * * * *